US005505641A

United States Patent [19]

Onoue

[11] Patent Number: 5,505,641

[45] Date of Patent: Apr. 9, 1996

[54] POWER TILT, POWER STEERING DEVICE

[75] Inventor: Akihiro Onoue, Hamamatsu, Japan

[73] Assignee: Sanshin Kogyo Kabushiki Kaisha, Hamamatsu, Japan

[21] Appl. No.: 376,090

[22] Filed: Jan. 20, 1995

Related U.S. Application Data

[63] Continuation of Ser. No. 137,847, Oct. 15, 1993, abandoned.

[30] Foreign Application Priority Data

Oct. 16, 1992 [JP] Japan ..... 4-303280

[51] Int. Cl.[6] ..... B63H 25/42

[52] U.S. Cl. ..... 440/61; 114/150

[58] Field of Search ..... 440/53, 61, 63, 440/88, 900; 114/144 R, 150; 74/480 B

[56] References Cited

U.S. PATENT DOCUMENTS

| | | | |
|---|---|---|---|
| 4,449,470 | 5/1984 | Rump | 440/61 |
| 4,482,330 | 11/1984 | Cook | 440/61 |
| 4,689,025 | 8/1987 | Ferguson | 440/61 |
| 4,836,810 | 6/1989 | Entringer . | |
| 5,149,285 | 9/1992 | Kinoshita | 440/61 |
| 5,350,326 | 9/1994 | Funami et al. . | |

*Primary Examiner*—Stephen Avila
*Attorney, Agent, or Firm*—Knobbe, Martens, Olson & Bear

[57] ABSTRACT

A hydraulic assisted outboard drive arrangement wherein the hydraulic assist is controlled by an electric motor driven fluid pump. To assure the availability of hydraulic fluid immediately upon demand, the electric motor is continuously driven at a low speed and is switched it a higher speed in the event of operator demand for power assist.

6 Claims, 4 Drawing Sheets

POWER TILT, POWER STEERING DEVICE

"This application is a continuation of application Ser. No. 08/137,847, filed Oct. 15, 1993" now abandoned.

BACKGROUND OF THE INVENTION

This invention relates to a power tilt, power steering device for an outboard drive and more particularly to an improved hydraulically assisted device for outboard drives.

It is well known that many forms of outboard drives employ hydraulic cylinders powered by an electric motor driven hydraulic pump for achieving tilt and trim operation. Recently, it has also been proposed to employ the same hydraulic source to provide a power assist for the steering. These types of hydraulic assists are particularly popular in connection with large displacement outboard drives such as large displacement outboard motors.

With such an arrangement, in order for the hydraulic assist to be available it is necessary to for the electric motor to be started and drive the hydraulic pump so as to generate sufficient hydraulic force for operation of the hydraulic motor. This can cause delays in the operation and also can result in high consumption of electrical energy.

It has been proposed to employ a system wherein an accumulator is charged by the hydraulic pump and this accumulator pressure is employed for the hydraulic assist. Although this type of device offers one solution to the problem, it is not necessarily the best one.

For example, when a hydraulic accumulator is required, it is necessary to provide additional hydraulic lines to and from the accumulator and the power assist devices. In addition, it is necessary to cycle the electric motor to insure that the accumulator is charged to adequate pressure and these systems generally operate on higher pressure than conventional systems.

It is, therefore, a principle object to this invention to provide an improved power assist system for an outboard drive.

It is a further object to this invention to provide a hydraulic assist mechanism for an outboard drive wherein there will be no delay in the availability of hydraulic fluid under pressure, but the use of accumulators and complicated circuitry are avoided.

It is a further object to this invention to provide an improved power assisted, tilt/trim and steering arrangement for a marine outboard drive.

SUMMARY OF THE INVENTION

This invention is adapted to be embodied in a power assist system for an outboard drive and which is comprised of an electric motor, a hydraulic pump driven by the electric motor for providing a source of pressurized fluid and a hydraulic motor driven by the hydraulic pump for operating a component of the outboard drive. In accordance with the invention, control means are provided for operating the electric motor continuously at a first rate regardless of operator demand for power assist and a greater rate when the power assist is required.

DETAILED DESCRIPTION OF THE PREFERRED EMBODIMENTS OF THE INVENTION

Figure 1:
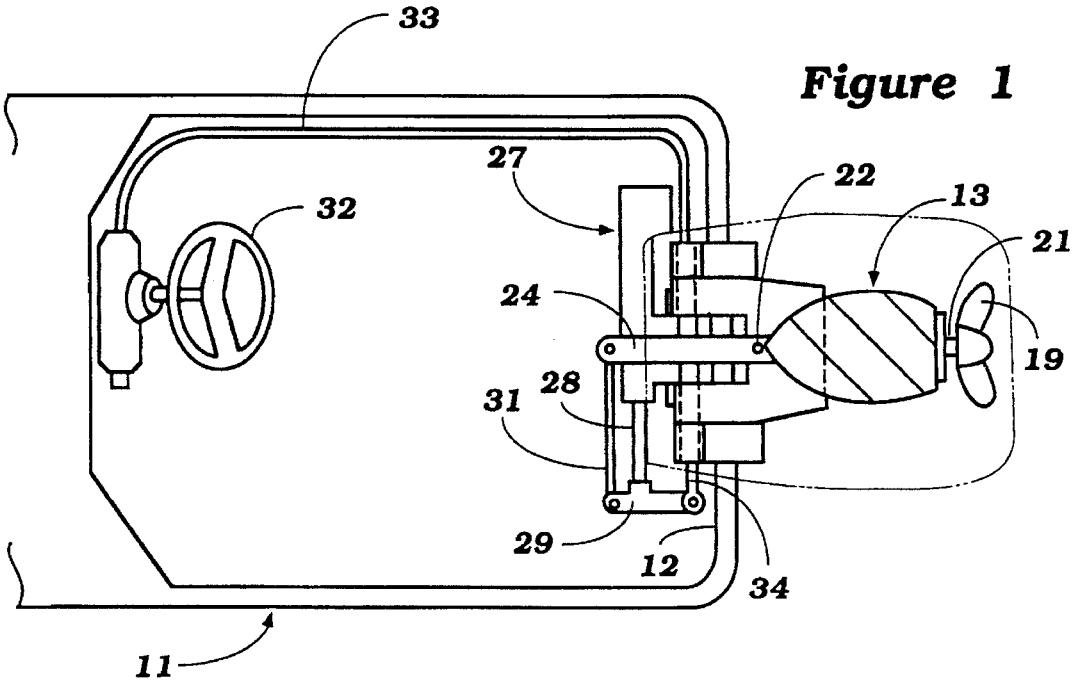
FIG. 1 is a top plan view of a portion of a watercraft having an outboard motor and power assist constructed in accordance with an embodiment of the invention.
Figure 2:
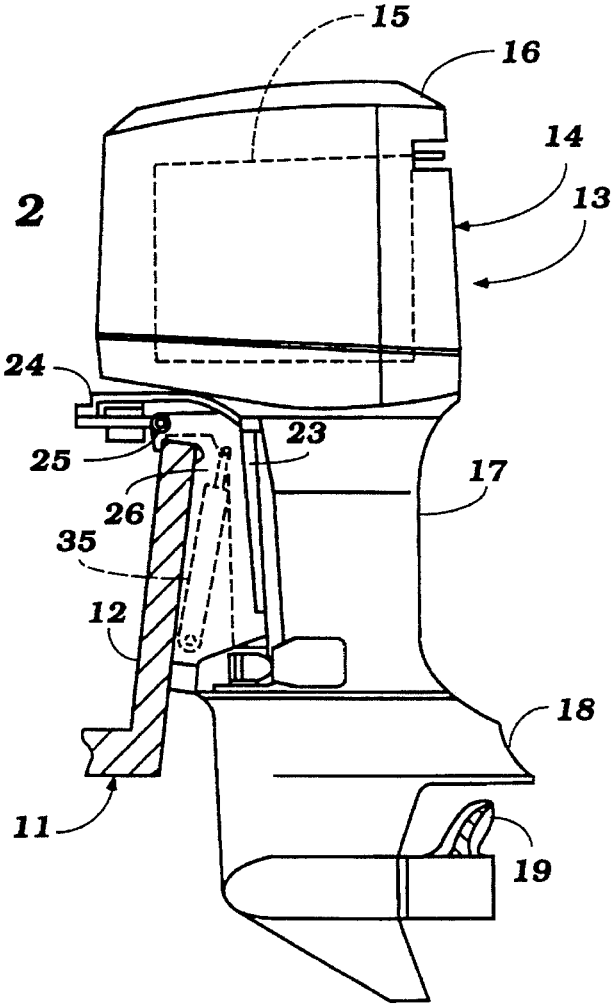
FIG. 2 is a side elevational view, with portions shown in cross section, and shows the attachment of the outboard motor to the transom of the watercraft.

Referring first to FIGS. 1 and 2, a watercraft is depicted partially and is identified generally by the reference numeral 11 and has a transom 12 to which an outboard motor, indicated generally by the reference numeral 13 is affixed in a manner to be described. The invention is described in conjunction with an outboard motor, but is to be understood that it can also be employed with marine outboard drive portions of an inboard/outboard drive. Therefore, the term "outboard drive" is used herein and in the claims to describe generically either an outboard motor or the outboard drive portion of an inboard/outboard drive.

The outboard motor 13 is comprised of a powerhead, indicated generally by the reference numeral 14 which is comprised of an internal combustion engine, shown only in outline form in dotted lines at 15 in FIG. 2, and an encircling protective cowling 16. The engine 15 may be of any known type and; as is typical with outboard motor practice, the engine 15 is supported with its output shaft rotating about a generally vertically extending axis. This output shaft drives a drive shaft (not shown) that is contained within a drive shaft housing 17 and is suitably journaled therein. The drive shaft continues on to a lower unit 18 in which a propeller 19 is mounted on a propeller shaft 21 which is driven by the aforenoted drive shaft through a conventional forward, neutral, reverse transmission.

A steering shaft 22 is affixed to the drive shaft housing and contained within a swivel bracket 23 and supported for steering movement about a generally vertically extending steering axis by the swivel bracket 23. A steering arm or tiller 24 is connected to the steering shaft 22 for steering of the outboard motor 13 in a manner which will be described.

The swivel bracket 23 is, in turn, pivotally connected by means of a pivot pin 25 to a clamping bracket 26 which is mounted in a known manner on the transom 12 of the watercraft 11.

In accordance with a feature of the invention, a hydraulically assisted steering mechanism is coupled to the tiller 24 for hydraulically assisted steering of the outboard motor. This hydraulically assisted steering system includes a hydraulic motor 27, which will be described in more detail by reference to FIG. 3, which has a piston rod 28 that is connected to a steering link 29. The steering link 29 is, in turn, coupled to the tiller 24 by a steering link 31.

A remotely positioned steering wheel 32 is positioned in the operator's compartment of the watercraft 11 and is connected by means of a bowden wire cable assembly 33 to a steering member 34 that is suitably slidably supported in the mechanism thus far described. The steering construction also includes a servo valve which will be described in conjunction with FIG. 3 that selectively pressurizes the fluid motor 27 in response to steering inputs from the steering wheel 32 so as to provide the requisite steering assist force for the outboard motor 13.

As has been noted, the pivot pin 25 permits tilt and trim movement of the outboard motor 13 and a hydraulic trim cylinder, indicated generally by the reference numeral 35, is connected between the clamping bracket 26 and swivel bracket 23 for effecting this tilt and trim movement. The hydraulic cylinder 35 and the remaining portion of the hydraulic system will be described by reference to FIG. 3.

The construction of the outboard motor 13 as thus far described may be considered to be conventional and, for that reason, further details of its construction and operation are not believed to be necessary to permit those skilled in the art to practice the invention. The invention deals primarily with the way in which the steering fluid motor 27 and tilt and trim fluid motor 35 are actuated and controlled and that construction will now be described in connection with this embodiment by reference to FIG. 3.

Figure 3:
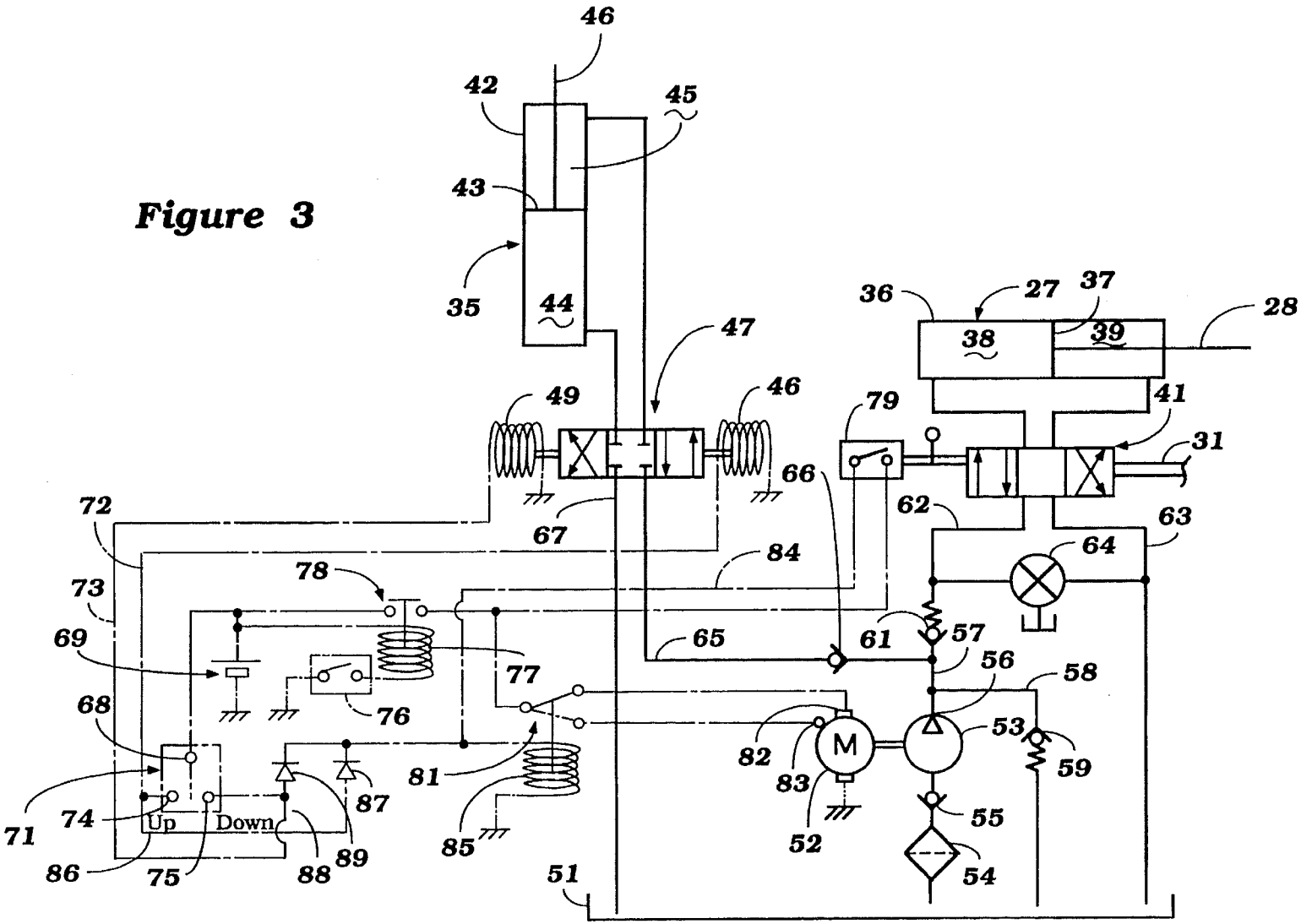
FIG. 3 is a partially schematic electrical and hydraulic diagram showing a first embodiment of the invention.

Referring now to FIG. 3, the steering fluid motor 27 is comprised of a cylinder housing assembly 36 having a cylinder bore in which a piston 37 is slidably supported so as to define a pair of fluid chambers 38 and 39. The piston rod 28 is affixed to the piston 37 and, as aforenoted, to the steering link 29.

A control valve assembly, indicated generally by the reference numeral 41 is provided which is illustrated as a three position, two-way valve and is selectively moveable from a neutral position, as shown in FIG. 3, to a right turn position and a left turn position as controlled by the link 31 under actuation from the steering wheel 32. It should be noted that the valve 41 is actually of the open center type so that there will be slight fluid flow through the valve 41 even in the neutral position, but this fluid flow will be balanced and no steering effect will be generated.

In a similar manner, the tilt and trim fluid motor 35 is comprised of a cylinder housing 42 which is connected, as aforenoted, to the clamping bracket 26 and in which a piston 43 is supported so as to divide the cylinder bore of the cylinder assembly 42 in to a lower tilt or trim up chamber 44 and an upper tilt or trim down chamber 45. A piston rod 46 is connected to the piston 43 and, as aforenoted, is connected to the swivel bracket 23.

The operation of the tilt and trim fluid motor 35 is controlled by a selector valve 47 which is electrically operated and which has a tilt/trim up winding 48 and a tilt/trim up winding 49 which selectively pressurize the chambers 44 down 45, respectively, while dumping the non-pressurized chamber. The tilt and trim valve 47 is also shown in its neutral position in FIG. 3 and this position may also have an open center relationship so that some fluid flow is permitted even when in the neutral position although this flow will be balanced.

The hydraulic system further includes a reservoir, shown schematically at 51 which may be part of a pump, motor assembly which is mounted preferably within the transom of the watercraft 11 or alternatively on the rear of the transom. This system further includes an electric motor 52, a hydraulic pump 53 which draws fluid from the reservoir 51 through a filter 54 and one-way check valve 55 for delivery, in a manner to be described, to the steering control valve 41 and the tilt and trim control valve 47. An output port 56 of the pump 53 is connected to a line 57 from which a bypass line 58 in which a pressure relief valve 59 is provided for bypassing excess fluid back to the reservoir 51 for pressure relief.

The line 57 is connected by means of a pressure responsive valve 61 to a delivery line 62 of the steering control valve 41. In addition, a return line 63 extends from the steering control valve 41 back to the reservoir 51. It should be readily apparent that the control valve when moved to the right as shown in FIG. 3 will pressurize the chamber 38 and dump the chamber 39 back to the reservoir 51 through the return line 63 and vice versa. In order to permit manual steering, a bypass valve 64 extends between the lines 62 and 63 and may be opened manually so as to permit manual steering without interference from the hydraulic system in the event of failure of the hydraulic system.

The pump output line 57 also communicates with a further conduit 65 that extends to the tilt and trim selector valve 47 with a check valve 66 being positioned in this line. The selector valve 47, which is electrically operated in a manner to be described, selectively pressurizes either the chamber 45 for trim or tilt down movement or the chamber 44 for tilt and trim up movement with the remaining chamber being dumped back to the reservoir 51 through a return line 67.

Electric power for the system as thus far described is provided by a battery, indicated generally by the reference numeral 68, which is charged by a suitable charging system associated with the internal combustion engine 15 of the powerhead 14. The battery 68 is connected directly to a neutral terminal 69 of the trim or tilt adjusting switch, indicated generally by the reference numeral 71 and which is designed so as to be operator controlled so as to selectively energize either the tilt up winding 48 or tilt down winding 49 of the selector valve 47 through the respective conductors 72 and 73, respectively. Normally the up and down terminals 74 and 75 of the selector 71 would also be connected to the motor 52 so that it would be energized when the operator selects tilt or trim up operation. In accordance with this invention, however, such a direct control is not provided, as will become apparent as the description proceeds.

The watercraft 11 and specifically its control circuit includes a main switch 76 which the operator can energize so as to switch on the entire electrical system, except for the selector valve 71 which is always energized. The switch 76 is connected to a winding 77 of a relay switch 78 which, when energized, energizes a circuit to a steering control switch 79. The switch 79 is interconnected normally between the battery 68 and the motor 52 and will turn on the motor 52 and pump 53 in the event the steering control valve 41 is moved from its neutral position so as to effect steering in either the right or left hand turn modes.

Hence, it should be readily apparent that with conventional constructions the electric motor 52 must begin to operate the pump 53 so as to generate hydraulic pressure before either power assisted steering or power tilt and trim is possible. However, in accordance with this invention, there is provided in this embodiment, a switching arrangement, indicated generally by the reference numeral 81, which is a two position switch normally biased to a first position as shown in FIG. 3 wherein electrical current is always provided to the electric motor 51 through a low speed winding terminal 82 so long as the main switch 76 is closed. Hence, when the main switch 76 is closed, the closure of the relay switch 78 will energize the switch 81 and provide electrical current to the motor terminal 82 so as to drive the electric motor 52 at a low speed and low load, but which will nevertheless operate the pump 53 so as to provide fluid pressure at a relatively constant low pressure at the outlet port 56 and line 57 at all times when the main switch 76 is closed. Hence, if either power steering or tilt or trim movement is required, there will be available immediately hydraulic fluid under pressure to effect this operation.

In addition, when either tilt or trim movement or power steering assist is required, the switch 81 will be moved from the position shown in FIG. 3 to the dotted line position shown in FIG. 3 so as to energize a second high speed terminal 83 of the electric motor 52 so as to drive it at the normal high speed relationship. This is the important feature of this invention and the manner in which this switching from low speed to high speed operation is accomplished will now be described by continue reference to FIG. 3.

Considering first the situation when steering is called for, as has been previously noted, the switch 79 of the power steering assembly is actuated when the steering control valve 41 is shifted from its neutral position. The switch 79 then closes a circuit to a conductor, shown schematically at 84 which energizes the solenoid winding 85 so as to move the switch 81 from the position wherein the motor low speed terminal 82 is energized to the position where the motor high speed terminal 83 is energized and hence, the motor 52 and pump 53 will be driven at a high speed so that full hydraulic power will be available for the steering assist.

As soon as the steering operation has been completed and the steering control valve 41 is turned to its neutral position, then the switch 79 will again be opened and the winding 85 of the switch 81 will be de-energized and the electric motor 52 will be again powered through its low speed terminal 82 so as to operate at a low speed, but still maintain sufficient hydraulic power available in the event hydraulic operation is required.

The solenoid winding 85 of the motor speed control switch 81 is also wired into the tilt and trim selector switch 71 in a manner now to be described so that the electric motor 52 will be energized through its high speed terminal 83 in the event the operator calls for tilt or trim operation. To this end, the tilt up switch terminal 74 is connected by means of a conductor 86 and diode 87 to the solenoid winding 85 and the tilt down terminal 75 is connected by a conductor 88 and diode 89 to this same winding 85. Hence, immediately upon the operator calling for tilt or trim up or down movement by operating the tilt/trim switch 71, the solenoid winding 85 will be energized and the motor speed control switch 81 will be energized so as to supply electrical power to the high speed terminal 83 of the motor 52 so that high speed operation will be accomplished. Again, however, hydraulic power will be available even before the motor 52 reaches its high speed condition so that delays will be avoided. In addition, since the motor 52 is always driven at a low speed, there will not be large electrical power consumptions required so as to accelerate the motor 52 to its high speed condition from dead stop when power steering assist or tilt or trim operation are required.

Figure 4:
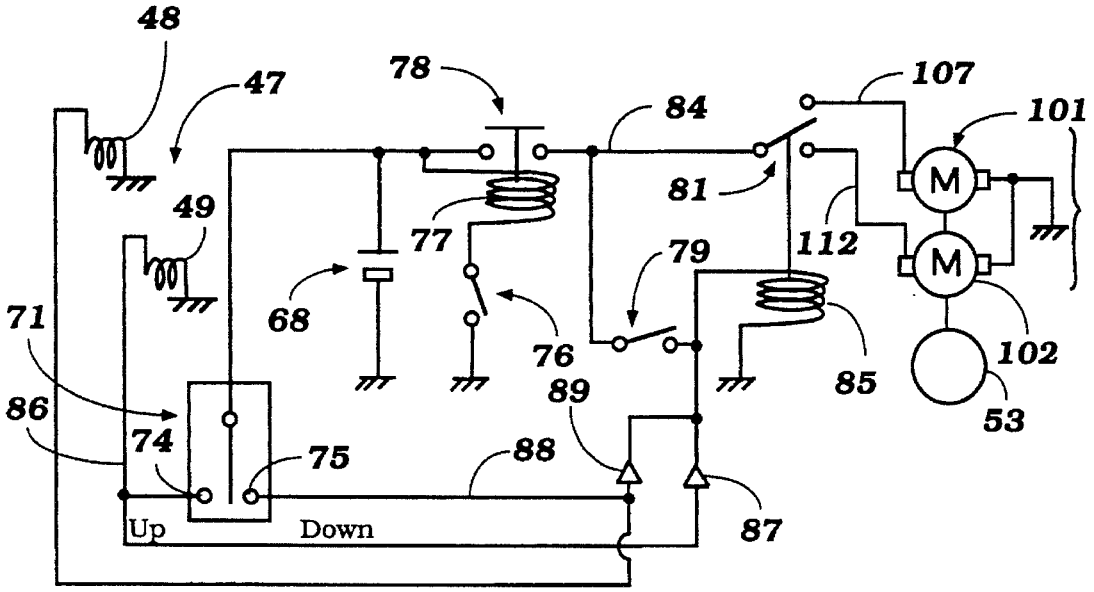
FIG. 4 is a partially schematic electrical diagram showing a second embodiment of the invention.
Figure 5:
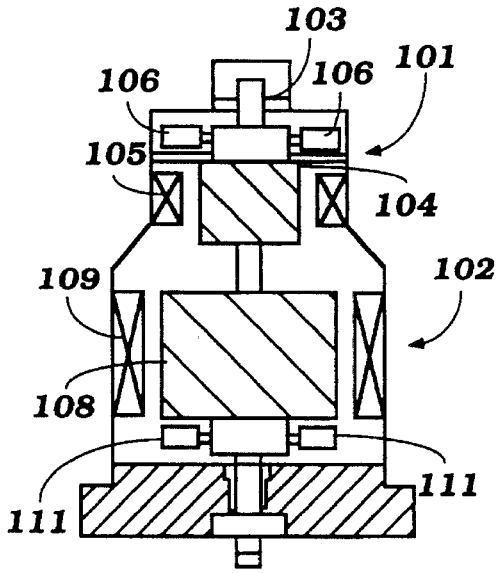
FIG. 5 is a cross sectional view taken through the electric motor of this embodiment.

FIGS. 4 and 5 show another embodiment of the invention which is generally the same as that of FIGS. 1 through 3 and, for that reason, components which are the same have been depicted by the same reference numerals and will be described again only insofar as is necessary to understand the construction and operation of this embodiment. The main difference between this embodiment and that previously described, is in the driving motor for the pump 53. In the previous embodiment, the driving motor 52 had a pair of windings for its speed control. In this embodiment, the pump 53 is driven by a pair of drive motors, a first relatively low capacity motor, indicated generally by the reference numeral 101 and a second higher capacity motor indicated generally by the reference numeral 102.

As may be seen in FIG. 5, the motors 101 and 102 are associated in a common housing and both motors have a common drive shaft 103 which is coupled to the pump 53. The smaller motor 101 has an armature or winding 104 that cooperates with a stator 105 and is energized by a pair of brushes 106 that are supplied with electrical power from a conductor 107. When the switch 81 is in its normal position, the circuit from the line 84 to the line 107 is completed and the motor 101 will be driven at its normal speed anytime when the main switch 76 is closed since the line 84 will be energized and thus electrical power will always be present and the pump 53 will always be driven as long as the main switch is closed as with the previously described embodiment.

The larger motor 102 has a rotor 108 that cooperates with a stator 109 and which is energized by a pair of brushes 111 that are connected to a conductor 112 of the switch 81. As with the previously described embodiment, the motor 102 will be energized anytime operator power assist is called for. For example, if the trim control switch 71 is moved to either its up position or its down position, the solenoid winding 85 of the switch 81 will be energized either through the diodes 87 or 89, respectively to close the switch 81 into contact with the conductor 112 and energize the larger motor 102 for driving the pump 53 at full capacity.

On the other hand, if power steering assist is called for, the switch 79 will be closed of the power steering mechanism and this will energize the solenoid winding 85 of the switch 81 to again close the circuit with the conductor 112 and drive the pump 53 by the higher capacity motor 102. Hence, this embodiment operates substantially the same as the previously described embodiment and, for that reason, further discussion of this embodiment is not believed to be necessary.

Figure 6:
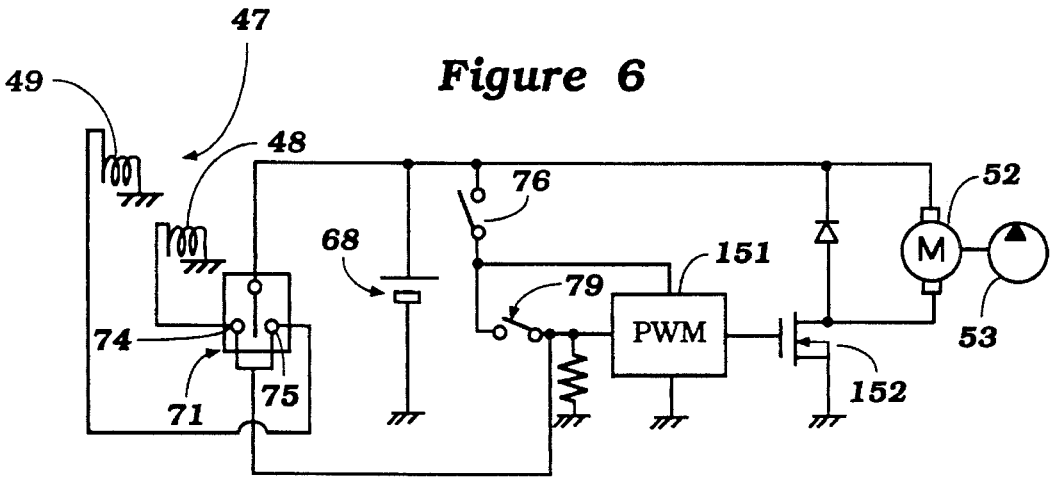
FIG. 6 is a schematic electrical diagram, in part similar to FIGS. 3 and 4, and shows another embodiment of the invention.
Figure 7:
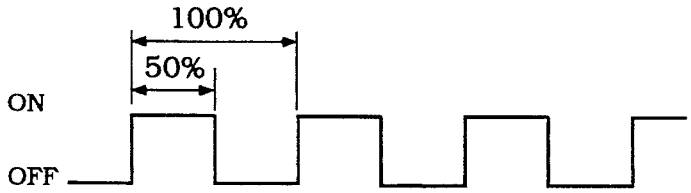
FIG. 7 is a diagram showing the duty cycles employed in the embodiment.

FIGS. 6 and 7 show another embodiment of the invention which differs from the previous embodiments only in the construction of the electric motor 52 for driving the pump 53 and its operation. In this embodiment, the electric motor 52 has its speed controlled by varying the duty cycle of the electricity that is delivered to it and hence, it does not require a separate high and low speed windings as the embodiment of FIGS. 1 through 3 or two separate motors as with the embodiments of FIGS. 4 and 5. In this embodiment, the power circuit for the motor 52 includes a pulse width modulator 151 which is in circuit with the power steering switch 79 and the closure of the terminal 74 or 75 of the trim/tilt control switch 71. The pulse width modulator 151 switches a field effect transistor 152 so as to vary the duty cycle for the motor 52 as shown in FIG. 7. The field effect transistor 152 which normally will be switched on the pulse width modulator 151 for one half of a duty cycle as shown in FIG. 7 so that the electric motor 52 will only be driven one half of the time and hence, at a reduced speed. However, if either the power steering switch 79 is closed or one of the terminals 74 or 75 of the tilt adjusting switch is closed, then the pulse width modulator 151 will act to leave the field effect transistor 152 switched on for 100% of the time and it will receive full power at full speed. Hence, like the previously described embodiments, this device will provide hydraulic pressure even when it is not called for so that the motor 52 only need move to maximum speed but that fluid motor assist will be available immediately when called for.

Figure 8:
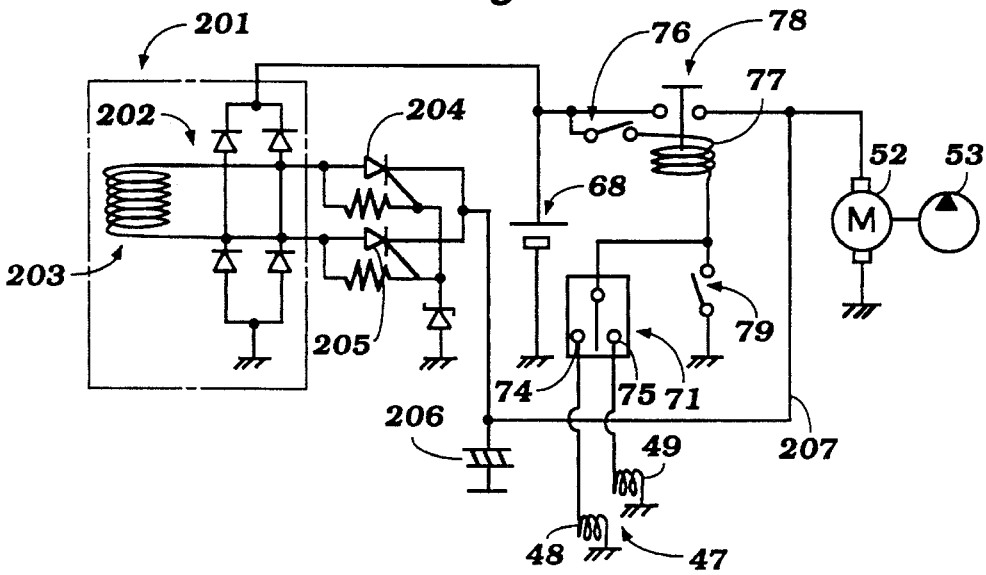
FIG. 8 is a schematic electrical diagram, in part similar to FIGS. 3, 4 and 6 and shows a still further embodiment of the invention.

FIG. 8 shows another embodiment of the invention which differs from the previously described embodiments only in the way in which the speed of the motor 52 is controlled so as to operate the motor 52 continuously at a low speed once the main switch is turned on and at a higher speed once either power steering assist or tilt and trim operation is required. Again, because of the similarity to the previously described embodiments, components which are the same as those previously described have been identified by the same reference numerals and will be described again only insofar as is necessary to understand the construction and operation of this embodiment.

In FIG. 8, the charging circuit for the battery 68 is also illustrated and this includes a magneto generator arrangement 201 having a diode bridge 202 for rectifying the output current of the charging coil 203 of the magneto generator of the engine, which has been previously referred to. A regulating circuit comprised of a pair of thyristors 204 and 205 regulate the output of the charging circuit as applied to the battery 68 with a condenser 206 being provided in the output circuit. In accordance with this embodiment of the invention, the regulator regulates the output voltage of the charging circuit 201 to something less than the full potential of the battery. For example, if the battery 68 is a 12 volt battery, the output of the charging circuit will be 6 volts. In addition to .being connected to the battery 68, the rectified and regulated output from the thyristors 204 and 205 is connected to the motor terminal through a conductor 207 so that the motor 52 is normally powered only by the charging circuit and hence, will be driven at a reduced speed which is the normal speed at times when the engine is running.

The winding 77 of the main relay switch 78 is connected to the ground either through the steering assist switch 79 or through the trim switch terminals 74 and 75 so that when the main switch 76 is closed, the switch 78 will be opened and the only electrical power supplied to the motor 52 will be that from the regulating circuit as aforedescribed. However, if the operator calls for either power steering so that the switch 79 is closed or tilt and trim operation so that either of the terminals of the tilt and trim switch 71 are closed, then the winding 77 will be energized and the relay switch 78 will be closed so that battery voltage will be applied to the motor 52 and it will speed up as with the previously described embodiment.

It should be readily apparent from the foregoing description that the described embodiments of the invention conserve electrical power and permit the use of a relatively simply hydraulic circuit by always driving the electric motor for driving the hydraulic pump at a low speed. However, when power assist is required the speed of the motor is immediately increased but fluid power will be available for assist immediately and before the speed of the motor increases to its maximum speed. Of course, the foregoing description is that of preferred embodiments of the invention and various changes and modifications may be made without departing from the spirit and scope of the invention, as defined by the appended claims.

I claim:

1. A power assist system for a marine outboard drive comprised of a first hydraulic motor for effecting hydraulically assisted steering of said outboard drive and a second hydraulic motor for effecting tilt and trim of said outboard drive, an electric motor, a hydraulic pump driven by said electric motor for providing a source of pressurized fluid to both of said hydraulic motors, operator activated means for calling for steering and/or tilt and trim of said outboard drive, and control means for operating said electric motor continuously at a at least a first relatively low power regardless of operator demand for power assist for either steering or tilt and trim of said outboard drive and at an increase power when power assist is demanded by the operator.

2. A power assist system for a marine outboard drive as set forth in claim 1 wherein the electric motor is driven at the greater rate in response to the operator demand for power assist.

3. A power assist system for a marine outboard drive as set forth in claim 2 wherein the rates of the electric motor are a low speed and a high speed rate.

4. A power assist system for a marine outboard drive as set forth in claim 3 wherein the low speed rate and high speed rate are achieved by varying the electric power applied to the electric motor.

5. A power assist system for a marine outboard drive as set forth in claim 3 wherein the varying speed rates are achieved by varying the duty cycle for the driving of the electric motor.

6. A power assist system for a marine outboard drive as set forth in claim 5 wherein the varying speed rate of the electric motor is provided by two electric motors, one having a lower speed than the other.

* * * * *